United States Patent [19]

Maczuszenko et al.

[11] Patent Number: 4,595,277

[45] Date of Patent: Jun. 17, 1986

[54] TONER SUPPLY CONTROL SYSTEM

[76] Inventors: Andrzej Maczuszenko, 92 Pennyhill Drive, Scarborough, Ontario M1B 3J9; Sotos M. Theodoulou, 23 Greenmount Road, Bramalea, Ontario L6S 1C3; Kenneth L. Hurley, 38 Buchanan Drive, Unionville, Ontario L3R 4C7; Dolf Landheer, 26 Euclid Avenue, Ottawa, Ontario K1S 2W3, all of Canada

[21] Appl. No.: 574,820

[22] Filed: Jan. 30, 1984

[30] Foreign Application Priority Data

Feb. 1, 1983 [CA] Canada ..... 420680

[51] Int. Cl.[4] ..... G03G 15/08

[52] U.S. Cl. ..... 355/14 D; 355/3 DD; 222/201; 222/202

[58] Field of Search ..... 355/3 DD, 14 D; 430/121, 122, 123; 118/656, 657, 658; 222/201-203; 209/254, 324, 373

[56] References Cited

U.S. PATENT DOCUMENTS

| | | | |
|---|---|---|---|
| 1,814,488 | 7/1931 | Murnahan | 222/201 X |
| 3,233,781 | 2/1966 | Grubbs | 355/14 D |
| 4,372,672 | 2/1983 | Pries | 355/3 DD X |
| 4,408,862 | 11/1983 | Takano et al. | 355/3 DD |
| 4,418,643 | 12/1983 | Barto, Jr. et al. | 118/657 |
| 4,420,242 | 12/1983 | Yamashita | 355/3 DD |
| 4,422,405 | 12/1983 | Kasahara et al. | 355/3 DD X |
| 4,422,750 | 12/1983 | Kawata | 118/657 X |
| 4,428,661 | 1/1984 | Masuda et al. | 355/3 DD |
| 4,432,634 | 2/1984 | Tabuchi | 355/14 D |
| 4,435,065 | 3/1984 | Wada | 118/658 X |
| 4,444,864 | 4/1984 | Takahashi | 430/122 X |
| 4,451,134 | 5/1984 | Fukuchi et al. | 430/122 X |
| 4,457,613 | 7/1984 | Kopp et al. | 355/14 D X |
| 4,460,266 | 7/1984 | Kopp et al. | 355/14 D X |
| 4,462,680 | 7/1984 | Ikeda | 355/14 D |
| 4,466,379 | 8/1984 | Nishimura | 118/658 |
| 4,466,728 | 8/1984 | Schlageter et al. | 118/658 X |

FOREIGN PATENT DOCUMENTS

| | | | |
|---|---|---|---|
| 0098835 | 8/1978 | Japan | 355/3 DD |
| 0115061 | 9/1980 | Japan | 355/3 DD |
| 0154770 | 11/1981 | Japan | 355/3 DD |
| 0165180 | 12/1981 | Japan | 355/3 DD |
| 2069879 | 9/1981 | United Kingdom | 118/657 |
| 2098096 | 11/1982 | United Kingdom | 118/658 |

OTHER PUBLICATIONS

IBM Technical Disclosure Bulletin; vol. 15, No. 4, Sep. 1972; Freeman et al.

*Primary Examiner*—R. L. Moses

*Attorney, Agent, or Firm*—Hirons, Rogers & Scott

[57] ABSTRACT

The invention provides an agitator for releasing powder toner through a bottom opening of a hopper. The agitator has a screen for placing over the opening and an element which, when positioned in the hopper, is in contact with the upper surface of the screen. Toner normally bridges the openings in the screen so that there is normally no flow through the screen and the element is operable to brush over the upper surface of the screen to break down the bridging locally, thereby effectively sifting powder toner through the screen. On stopping the element, the toner again bridges the openings and flow of toner stops. The invention also provides a feeder which magnetically transports toner received from the hopper, and an applicator which takes the toner magnetically from the feeder and transports the toner to the point of use.

6 Claims, 3 Drawing Figures

TONER SUPPLY CONTROL SYSTEM

This invention relates to toner systems for use in delivering powder toner from a storage hopper to an element carrying an electrostatic pattern of charge to be toned before transfer to a receptor such as paper.

Powder toner is transported from a storage area to the point of use in a copier or printer in one of two distinct ways. Firstly, in one type of system, the toner is elevated from a trough or other storage device and any excess toner is allowed to fall back into the trough. In a second type of system, the powder toner is supplied under gravity from an opening at the bottom of a hopper and transported from this opening to the point of use. The present invention is of the latter type for use with toner suitable for cold pressure fusing and consisting of particles of iron oxide coated in toner and commonly referred to as "single component toner". Toner particles of this type, by their very nature, tend to agglomerate under pressure so that there is a tendency at the bottom of a hopper for the particles to attach to one another to form lumps and bridging across the bottom opening. Both conditions detract from the efficient flow of toner and have in fact influenced development work away from cold pressure fusing because of the difficulties inherent in handling this type of toner. The conditions are aggravated by the need to store a significant supply of toner if the associated machine is to operate for a reasonable period of time between servicing because the toner settles in the hopper thereby removing air which is essential for smooth flow of the toner.

The desired rate of flow of toner cannot be predetermined because it is used to tone a series of electrostatic patterns which have varying demands for toner. This has lead designers to approach the problem by ensuring tnat excess toner is available at all times and this of course leads to the problems of lumping and bridging already mentioned.

The present approach is in two parts. Firstly, toner is retained in a hopper remote from the point of use until released on demand, and secondly at all times between the hopper and the point of use, the static load in the toner is minimised and the particles of toner are kept in motion by magnetic fields which control not only the flow to the point of use, but also recirculation of toner which is again delivered to the point of use.

Accordingly, in one of its aspects, the invention provides an agitator for releasing powder toner through a bottom opening of a hopper. The agitator has a screen for placing over the opening and an element which, when positioned in the hopper, is in contact with the upper surface of the screen. Toner normally bridges the openings in the screen so that there is normally no flow through the screen and the element is operable to brush over the upper surface of the screen to break down the bridging locally, thereby effectively sifting powder toner through the screen. On stopping the element, the toner again bridges the openings and flow of toner stops.

In another of its aspects, the invention provides a combination toner release means for use with a bottom opening of a hopper, a feeder which magnetically transports toner received from the hopper, and an applicator which takes the toner magnetically from the feeder and transports the toner to the point of use. Control means associated with the release means senses a need for toner and causes the release means to allow a restricted supply of toner to flow towards the feeder. The feeder and applicator restrain the toner magnetically both in travelling to the point of use and also in recirculating excess toner not needed at the point of use.

These and other aspects of the invention will become apparent from the following description taken in combination with the drawings, in which.

Figure 1:
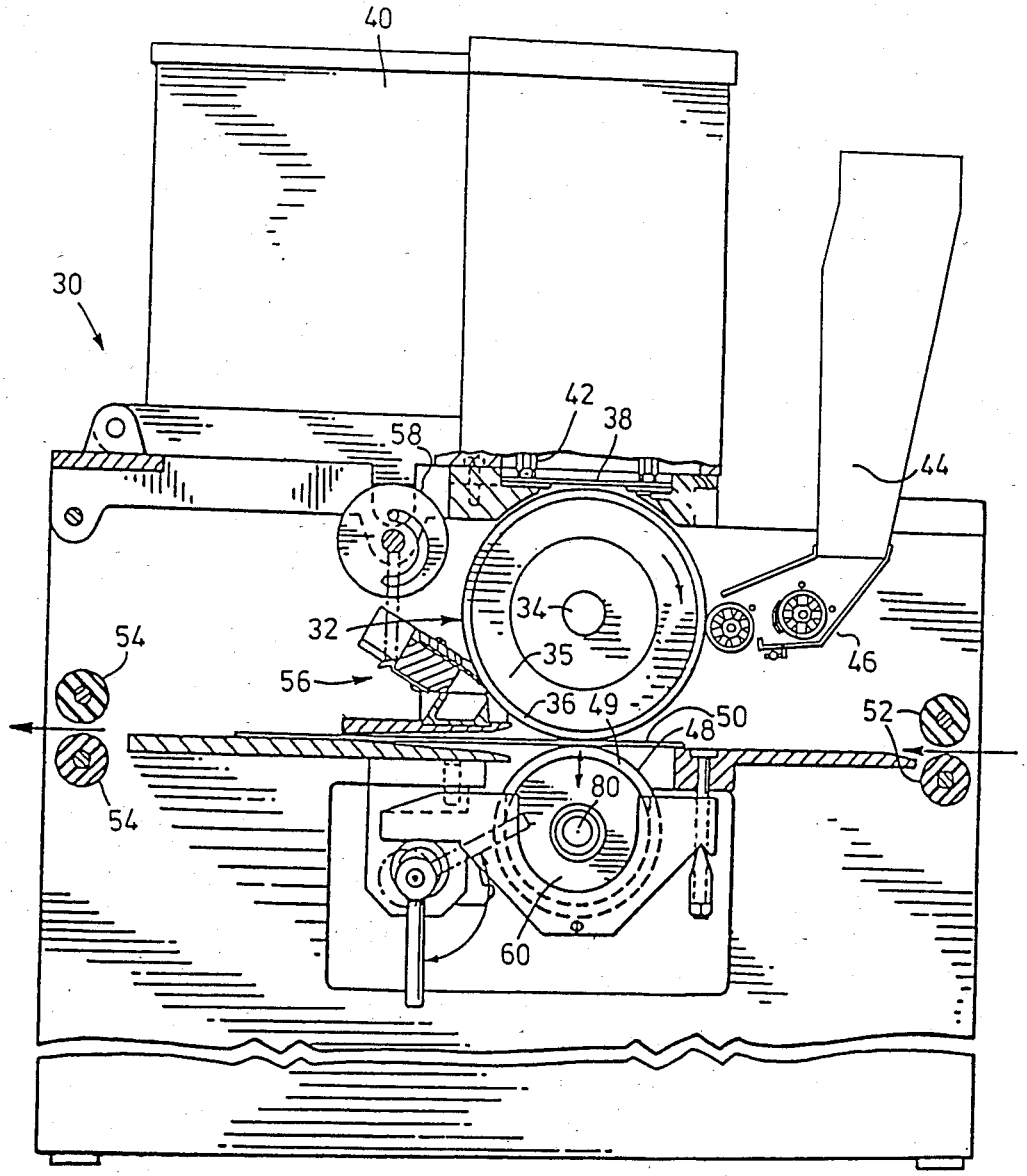
FIG. 1 is a diagrammatic side view, partially in section, of an exemplary electrostatic printer using a toner system according to a preferred embodiment of the invention.

Reference is made first to FIG. 1 which shows somewhat schematically an exemplary electrostatic printer 30 incorporating the invention. This printer is illustrated primarily to demonstrate a suitable environment for the invention. Other printers and also photocopiers using photoreceptors could also benefit from the use of the invention. A cylinder 32 is mounted for rotation about an axis 34 and has an electrically conductive core 35 coated in a dielectric layer 36 capable of receiving an electrostatic image from a cartridge 38 driven by an electronic control system 40 and connected by mechanical connectors 42. As the cylinder rotates in the direction shown, an electrostatic image is formed by the cartridge 38 on the outer surface of the dielectric layer 36 and comes into contact with toner supplied from a hopper 44 by a feeder mechanism 46. The resulting toned image is carried by the cylinder 32 towards a nip formed with a pressure roller 48 having a compliant outer layer 49 positioned in a path of a receptor such as a paper 50 which enters between a pair of feed rollers 52, is driven by the cylinder 32 and roller 48, and leaves between a pair of output rollers 54. The pressure in the nip is sufficient to cause the toner to transfer to the receptor 50 and with sufficient pressure, the toner will be fused to the receptor.

After passing the nip between the cylinder 32 and the roller 48, any toner remaining on the surface of the dielectric layer 36 is removed by a scraper blade assembly 56, and any residual electrostatic charge remaining on the surface is neutralized by a discharge head 58 positioned between the scraper assembly 56 and the cartridge 38.

Figure 2:
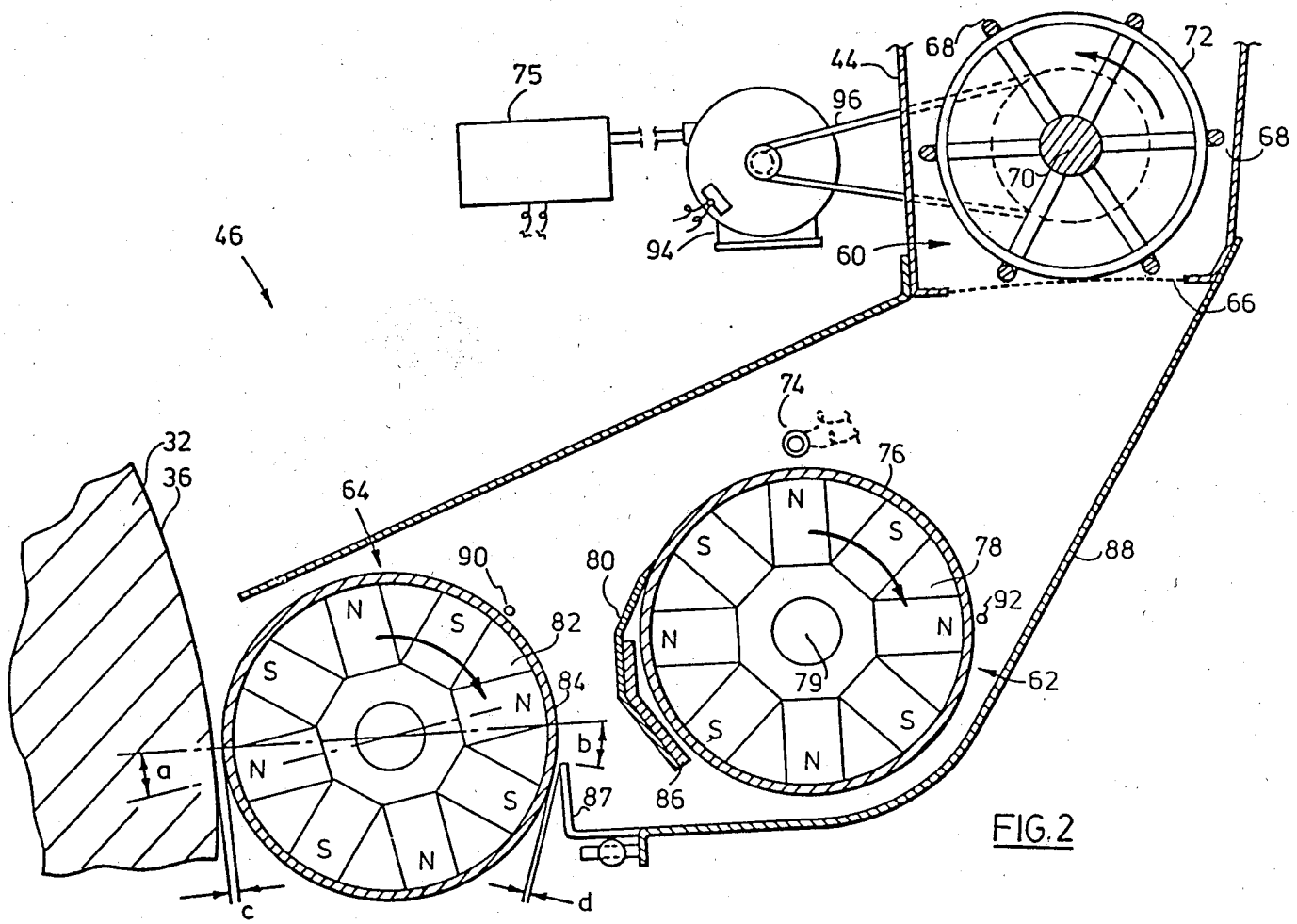
FIG. 2 is a sectional side-view of the toner system to a larger scale than that used in FIG. 1.

Reference is next made to FIG. 2 which illustrates the toner system 46 in greater detail and to a larger scale than that used in FIG. 1. Toner stored in the hopper 44 falls onto an agitator 60 which is controlled to meter toner as required by a feeder 62 forming, with the agitator, a supply device. As will be described, the feeder 62 transports toner to an applicator 64 which in turn carries the toner to the dielectric surface 36 of the cylinder 32.

Figure 3:
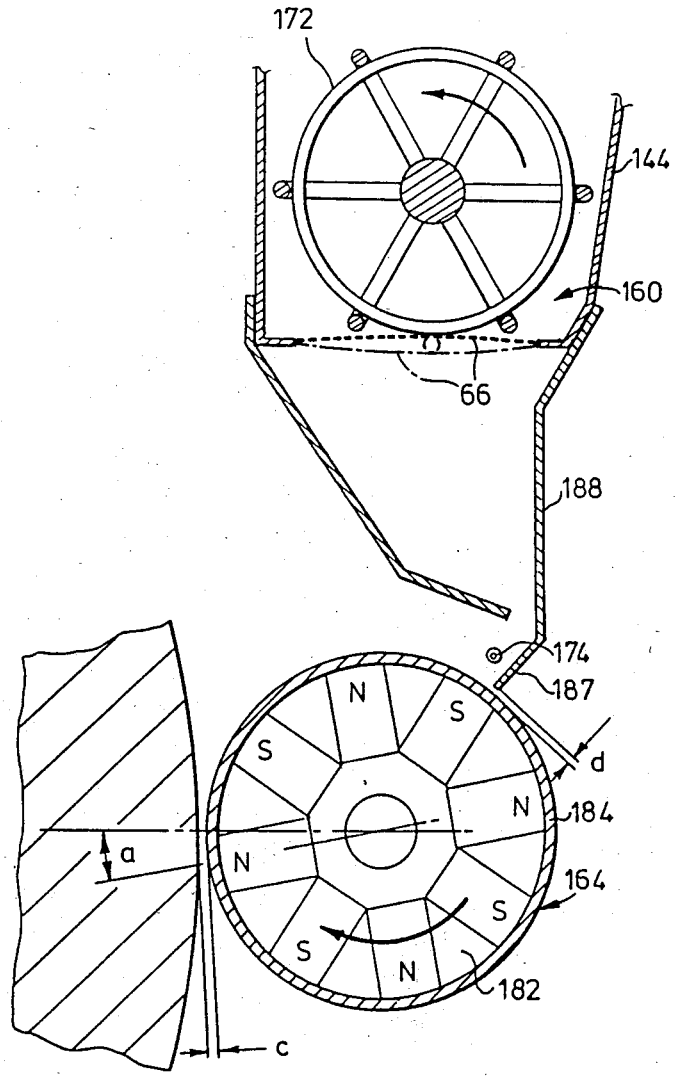
FIG. 3 is a view similar to FIG. 2 and showing an alternative embodiment of the toner system.

It has been found that one of the major difficulties of feeding toner is its tendency to build up into large masses which tend to hold the remaining toner in position in the hopper and prevent free-flow towards the cylinder 32. The present agitator overcomes this disadvantage even with toners which are particularly prone to this problem. The agitator consists of two major parts. Firstly, a screen 66 of stainless steel having 60 openings per inch and 37% open area is supported at its ends so that it assumes a generally cylindrical upward curvature at the bottom of the hopper (shown in broken outline). As shown in FIG. 3, the screen is deflected by contact with rods 68 which are spaced equally from an axis of rotation 70 of an agitator element 72. As this element rotates, the rods come into contact with the screen causing a sweeping action over the screen which breaks down bridges of toner existing over openings in the screen thereby sifting toner through the screen towards the feeder 62. This action is operated periodically as will be described. As soon as the element 72 stops, toner tends to bridge over the openings in the screen thereby supporting the toner in the hopper and preventing the weight of settled toner being applied to the feeder 62. Consequently, the feeder operates only in toner which is allowed to fall as a result of the operation of the agitator.

The amount of toner available to the feeder 62 is controlled by a sensor 74 and associated control circuit 75 which will be described with reference to FIG. 3. The feeder consists of a cylindrical outer shell 76 supported on bearings for rotation independently of a magnetic core 78 made up of a series of magnets arranged equally about an axis of rotation 79. These magnets are also rotatable about this axis driven independently of the shell. In the preferred embodiment, when toner is being fed and the agitator is stationary, the core rotates at a speed in the range 450 to 500 rpm and the shell moves in the same direction as that shown for the magnets in FIG. 2 at a slow speed of about 4 rpm. As will be described, the shell moves in the opposite direction at about the same speed when toner is being delivered by operation of the agitator.

Because of the rotation of the magnets in a clockwise direction (as drawn in FIG. 2), the mass of toner tends to move around the shell in an anti-clockwise direction meeting a scraper blade 80 set in position to cause the toner carried to this point to slide over the blade towards the applicator 64. The transfer of toner from the feeder to the applicator is essentially a transfer from one magnetic influence to another. Because the magnets in the feeder are moving at quite a high angular velocity, they set up an oscillating field on the blade 80 and the toner tends to "dance" along this blade. By contrast, the applicator consists of a similar mechanical structure having a core 82 of magnets and a shell 84. The stationary core 82 can be adjusted angularly as will be described to set up a stationary magnetic field into which the toner is drawn as it passes along the scraper blade 80 of the feeder.

In order to help control the magnetic field and enhance the flow of toner from the feeder 62 to the applicator 64, a magnetic shield 86 is located under the scraper blade 80 and adjacent the feeder 62 so that the magnetic field between the feeder and the applicator 64 is modified in the area covered by the shield. There will of course be a field below the shield and as already explained, above the shield where the toner moves down the scraper blade 80. The applicator is positioned adjacent the cylinder 32 and at its other side, a metering blade 87 controls the depth of toner on the applicator passing from within the enclosure 88 until it meets the cylinder 32 carried by the shell 84 which moves at a speed preferably in the range 250 to 350 rpm. The result is a pool of toner available for transfer to the cylinder as the surface of the cylinder passes the applicator. Any toner which is carried by the applicator 64 upwardly from the pool and back into the enclosure meets a toner discharge wire 90 which both agitates the toner and discharges any build-up of charge in the toner. It is necessary to have some excess of toner on the applicator as the toner approaches the metering blade 87 in order to ensure an adequate supply at the cylinder 32 where the pattern of charge to be toned will vary between a very sparse image to a very dense one requiring more toner.

Excess toner stripped by the blade 87 falls into the bottom of the enclosure 88, where it comes under the influence of the magnetic field set up by the core 78 of the feeder 62 below the shield 86. The toner is then carried in an anti-clockwise direction back around the feeder and meets a second discharge wire 92 to help break up possible lumps of toner which may have developed and to discharge the toner. The recirculated toner continues in the magnetic field meeting new toner supplied from the hopper 44.

The sensor 74 is an elongate member carrying a series of electrical contacts connected to the control circuit 75. Normally, the contacts are immersed in toner travelling about the feeder 62 so that there is electrical continuity between pairs of the contacts. Should one or more contacts be exposed outside the toner, the loss of electrical continuity is sensed and the control circuit activates a drive motor 94 which through belt 96 rotates the agitator element 72. The circuit 75 is adjusted to maintain this movement until there is again no demand for toner. There is also an alarm built into the circuit to indicate that a demand for toner is not being met within a predetermined time.

As described previously, toner passes over the scraper blade 80 and falls into the influence of the magnets forming the core 82 of the applicator 64 and is carried around past the blade 87 by the shell 84. Once toner reaches the surface of the cylinder 32, a pool of toner builds up between the applicator and the cylinder and the location and extent of this pool is dependent upon the angular position of the core 82. Preferred positions will be described. Excess toner then travels back to be used again.

In the preferred embodiment of the invention and using single component toner (used in cold pressure fixing) the following variables (See FIG. 1) were set as follows: a=5 to 10 degrees; b=9°30′ to 13°30′; c=30–35 thousandths of an inch; and d=25 to 30 thousandths of an inch. It will be appreciated that these variables can also be affected by changing the relative positions of the feeder, applicator and cylinder. However, they are identified both to give full details of the preferred embodiment and to illustrate what adjustments may have to be made for different toners, etc.

Reference is next made to FIG. 3 which illustrates an alternative embodiment of the toner system schematically. Numerals corresponding to those used with reference to FIG. 1 will be raised by 100 where the parts correspond in function. As seen in FIG. 3, a hopper 144 delivers toner to an enclosure 188 using an agitator 160. Flow of toner is controlled by a sensor 174 and the toner on an applicator 164 is controlled by a blade 187 at the lower extremity of the enclosure 188. A core 182 of the applicator 164 can be adjusted angularly as described with reference to the core 64 (FIG. 2) and the shell 184 rotates in the direction shown carrying with it toner past the blade 187.

Excess toner will be carried by the shell 164 back into the mouth of the enclosure 188 where it will again find use with new toner coming from the hopper 144.

Although the embodiment shown in FIG. 3 has use in many applications, it is not as desirable as the preferred embodiment shown in FIG. 2 where the toner is a particularly soft toner. To generalize, the FIG. 3 structure would be more likely to be used where the toner is hard and less likely to agglomerate. In the FIG. 2 structure, excess toner which is recirculated is caused to remain in motion and should any lumps develop below the feeder 62 (FIG. 2), the motion would tend to break these lumps up and provide recirculated toner to be used again. By contrast, there may be a tendency, should the toner be very soft for it to consolidate on places like the blade 187 and possibly even in the mouth of the enclosure 188.

We claim:

1. A toner system for feeding powder toner to a dielectric surface carrying an electrostatic image to be toned, the system comprising:

a hopper having a bottom opening;

an agitator including a screen having a top surface and a bottom surface with a plurality of wall means, each wall means defining a screen opening between the top surface and the bottom surface, the screen being placed across a hopper adjacent the bottom opening to support toner in the hopper, the toner bridging the screen openings and the screen being above a substantially toner free space;

an agitator element in contact with the top surface of the screen; and drive means operable to move the agitator element across the top surface of the screen to disrupt said toner bridging the screen openings and permit toner to fall through the screen openings into the toner free space until a predetermined amount of the toner collects in this space;

a cylindrical applicator positioned adjacent the dielectric surface for receiving toner from the agitator;

sensor means positioned to sense shortage of toner in said space and to provide a signal indicating such shortage; and means responsive to said signal and coupled to the agitator to drive the agitator to release more toner into said space for use on the applicator.

2. An agitator as claimed in claim 1 in which the screen is normally curved upwardly in the hopper and deflected downwardly by contact with the agitator element to ensure sliding contact between the agitator element and the screen and to enhance the action of the toner bridging said screen openings.

3. An agitator as claimed in claim 2 in which the agitator element is generally cylindrical and is mounted with its longitudinal axis generally horizontal, the agitator element including axially disposed rods around its curved surface which contact the screen and which are driven sequentially across the screen as the agitator element is driven to rotate about its longitudinal axis.

4. A toner system for feeding powder toner to a dielectric surface carrying an electrostatic image to be toned, the system comprising:

a hopper having a bottom opening;

an agitator including a screen having a top surface and a bottom surface with a plurality of wall means, each wall means defining a screen opening between the top surface and the bottom surface, the screen being placed across the hopper adjacent the bottom opening of the hopper to support toner in the hopper, the toner bridging the screen openings and the screen being above a substantially toner free space in the absence of agitation;

an agitator element in contact with an upper surface of the screen; and drive means operable on demand to move the agitator element across the upper surface of the screen to disrupt said toner bridging the screen openings and permit toner to fall through the screen openings into the space until a predetermined depth of the toner collects at the bottom of the hopper;

a feeder for receiving toner from the hopper and moving the toner past a selected location in said space;

sensor means positioned at said selected location in proximity to the feeder for sensing the absence of toner as the toner passes the sensor in proximity to the feeder and to create a demand signal upon sensing the absence of toner;

means coupled to the agitator and responsive to said demand signal to operate the agitator to relase more toner into said space; and an applicator located adjacent the dielectric surface and between the feeder and the dielectric surface for carrying toner from the feeder to the dielectric surface.

5. A toner system for applying controlled amounts of powder toner onto the dielectric surface of a cylindrical element carrying an electrostatic image to tone the image, the toner system comprising:

a toner hopper having a bottom outlet;

toner release means coupled to the hopper to contain the toner in the toner hopper and to release toner on demand;

an enclosure located below the toner hopper to contain toner released from the toner hopper and including a substantially toner free space immediately below the hopper;

a cylindrical feeder having a longitudinal axis parallel to the element and comprising a cylindrical magnetized core having alternate magnetic polarities spaced equally about its periphery, and a tubular shell containing the core, the shell and core being mounted in the enclosure for independent rotation about the longitudinal axis of the feeder;

a cylindrical applicator parallel to the feeder and positioned between the cylindrical feeder and the cylindrical element and adjacent the cylindrical element, the applicator including a further cylindrical magnetized core having alternate magnetic polarities spaced equally about its periphery and a further tubular shell containing the core, said further core being mounted for angular adjustment and said further shell being rotatable about the longitudinal axis of the applicator;

drive means for rotating the core of the feeder and the shell of the applicator continuously and for driving the toner release means intermittently to cause toner to move from the toner hopper to the surface of said cylindrical element;

sensor means for sensing shortage of toner in said space to create said demand at the toner release means, said sensor means also constituting means effective to activate the drive means to drive the toner release means in response to the creation of said demand, thereby causing the toner release means to release toner.

6. A method of controlling the transportation of powder toner from a hopper having a bottom outlet to the dielectric surface of an element having an electrostatic charge to be toned, the method comprising the steps:

supporting the toner in the hopper on a separator screen having screen openings above said bottom outlet;

agitating the toner immediately above the screen to break down bridging of toner over the screen openings on demand so that toner falls through the screen openings until the toner again bridges the screen openings;

providing a substantially toner free space immediately below the separator screen;

collecting the toner falling from the screen in magnetic fields below said space and created by a feeder having a cylindrical, rotating and magnetized core and a non-magnetic shell about the core, whereby the toner attaches to the shell and moves around the feeder;

collecting toner from the feeder and directing the toner towards stationary magnetic fields created by an applicator having a cylindrical, stationary and magnetized core and a cylindrical rotating non-magnetic shell whereby the toner leaving the scraper falls under the magnetic influence of the stationary core and is transported by the cylindrical rotating non-magnetic shell to the element where it is electrostatically attracted to the dielectric surface; and sensing shortage of toner in said space to create a demand signal to cause said toner agitation above the screen whereby toner falls into the space to satisfy said demand for toner.

* * * * *